United States Patent [19]

DePuy

[11] 4,318,154

[45] Mar. 2, 1982

[54] FAST RELAY TURN ON CIRCUIT WITH LOW HOLDING CURRENT

[75] Inventor: Robert P. DePuy, Cherry Hill, N.J.

[73] Assignee: General Electric Company, Philadelphia, Pa.

[21] Appl. No.: 197,397

[22] Filed: Oct. 16, 1980

[51] Int. Cl.[3] ..... H01H 47/32

[52] U.S. Cl. ..... 361/155

[58] Field of Search ..... 361/154, 155, 156

[56] References Cited

U.S. PATENT DOCUMENTS

| | | | |
|---|---|---|---|
| 3,021,454 | 2/1962 | Pickens | 361/155 |
| 3,064,165 | 11/1962 | Kennedy | 361/155 |
| 3,116,441 | 12/1963 | Gieffers | 361/154 |
| 3,483,395 | 12/1969 | Sauber | 361/155 |
| 3,660,730 | 5/1972 | Mason | 361/152 |

OTHER PUBLICATIONS

Transistor Circuit Analysis and Design by John J. Corning, Published by Prentice-Hall, Inc., Copyright 1965, Paragraph 15.7, p. 406.

*Primary Examiner*—J. D. Miller
*Assistant Examiner*—L. C. Schroeder
*Attorney, Agent, or Firm*—William Freedman; John P. McMahon

[57] ABSTRACT

A drive circuit responsive to an applied electrical signal for generating a voltage to control the actuation of an electromagnetic relay is disclosed. The voltage has a first and a second level for picking-up and holding-in, respectively, the relay. The first voltage level has a peak value which is developed by an internal charging circuit and is additive to the second voltage level supplied by an external source. The first voltage level is higher than required to actuate the relay which enhances the pick-up speed of the relay.

7 Claims, 3 Drawing Figures

FAST RELAY TURN ON CIRCUIT WITH LOW HOLDING CURRENT

BACKGROUND OF THE INVENTION

This invention relates to a relay drive circuit, and more particularly, to a relay drive circuit for an electromagnetic relay.

Electromagnetic relays are typically actuated or picked-up within a specified time duration, commonly termed the "pick-up" or "operate" time of the relays, by the application of a corresponding D.C. voltage across their energizing coil. The pick-up time of the relay decreases with increases in the level of the applied D.C. voltage. After the pick-up time of the relay has expired, the level of the applied D.C. voltage may be decreased and the relay will maintain or hold-in its actuated state.

In electrical systems, such as high-voltage distribution networks, electromagnetic relays are commonly used to interconnect various subsystems within the network. The various subsystems typically have an electronic circuit in their output stage which controls the application of a D.C. voltage for actuating an electromagnetic relay. The electronic circuit is commonly called "a relay drive circuit", and controls the application of the D.C. voltage to the relay typically developed from the power supply source of the subsystem.

The speed of response of the output stage of the subsystem is essentially controlled by the pick-up time of the electromagnetic relay. It is desirable that the subsystem have a relatively fast speed of response; however, electomagnetic relays typically have relatively long pick-up times. For example, the application of a D.C. voltage such as 18 V. D.C. may typically produce a relay pick-up time of 26 milliseconds. The pick-up time of the relay may be reduced by increasing the D.C. voltage level of the power supply source of the subsystem which in turn increases the D.C. voltage level generated by the relay drive circuit. Increasing the D.C. voltage level generated by the relay drive circuit in turn increases the D.C. voltage applied across the energizing coil to thereby increase the speed of response of the subsystem. It is desirable not to supply the large energizing voltage on a steady state basis. However, the overall electronic circuitry within the subsystem, excluding the electromagnetic relay, operates satisfactorily without increased D.C. voltage levels of the power supply. Therefore, it is considered undesirable to impose an overall increase to the subsystem power supply requirements to accommodate the needs of one particular user that being an electromagnetic relay that will be held in with the same D.C. voltage supplied.

Accordingly, it is an object of the present invention to provide a relay drive circuit which enhances the speed of response of the electromagnetic relay without causing any increase to the power supply requirements of the subsystem.

It is another object of the present invention to provide means whereby the D.C. level of energizing the operating signals for the electromagnetic relay controlled by the relay drive circuit may be adaptable to the requirements, such as pick-up and hold-in voltages, of the electromagnetic relay.

These and other objects of the invention will become apparent to those skilled in the art upon consideration of the following description of the invention.

SUMMARY OF THE INVENTION

The present invention is directed to a drive circuit responsive to an applied electrical signal for controlling the actuation of a relay having an energizing coil with a first and a second end arranged across an output stage of the circuit. The circuit is adapted to be energized by a D.C. voltage present between a positive and a negative potential. The circuit comprises a charging circuit, a second and a third diode, a first and a second switching means, and means for dissipating inductive stored energy of the energizing coil. The charging circuit comprises a serially-arranged first resistor, a capacitor and a first diode. The first resistor has a first end connected to the positive potential. The first diode has its cathode connected to the negative potential. The second and third diodes have their cathodes connected together. The second diode has its anode connected to a second end of the first resistor and to a first end of the capacitor. The third diode has its anode connected to the first end of the energizing coil. The second end of the energizing coil is connected to the positive potential. The first switching means has first, second and third electrodes. The first electrode is connected to the negative potential. The second electrode is adapted to receive the applied electrical signal. The third electrode is coupled to the connected cathodes of the second and third diodecapacitor to be charged to a voltage substantially equal to the D.C. voltage, and (ii) upon the occurrence of said applied electrical signal it is rendered conductive and supplies a path to forward-bias the second diode which provides a path to initiate a discharge of the capacitor. The second switching means has first, second, and third electrodes. The first electrode is connected to a second end of the capacitor. The second electrode is coupled by a second resistor to the negative potential. The third electrode is connected to the first end of the energizing coil. The seconcapacitor. The means for dissipating inductive stored energy is coupled to the energizing coil. The charging circuit, the second and third diodes, and the first and second switching means are arranged so that upon the occurrence of the applied electrical signal, both said first and second switching means are rendered conductive and an initial voltage equal to the sum of the charged potential of the capacitor and the D.C. voltage is applied across the energizing coil.

The features of the invention believed to be novel are set forth with particularity in the appended claims. The invention, itself, however, both as to its organization and operation, together with further objects and advantages thereof, may best be understood by reference to the following description taken in conjunction with the accompanying drawings.

DETAILED DESCRIPTION OF THE PREFERRED EMBODIMENT

Figure 1:
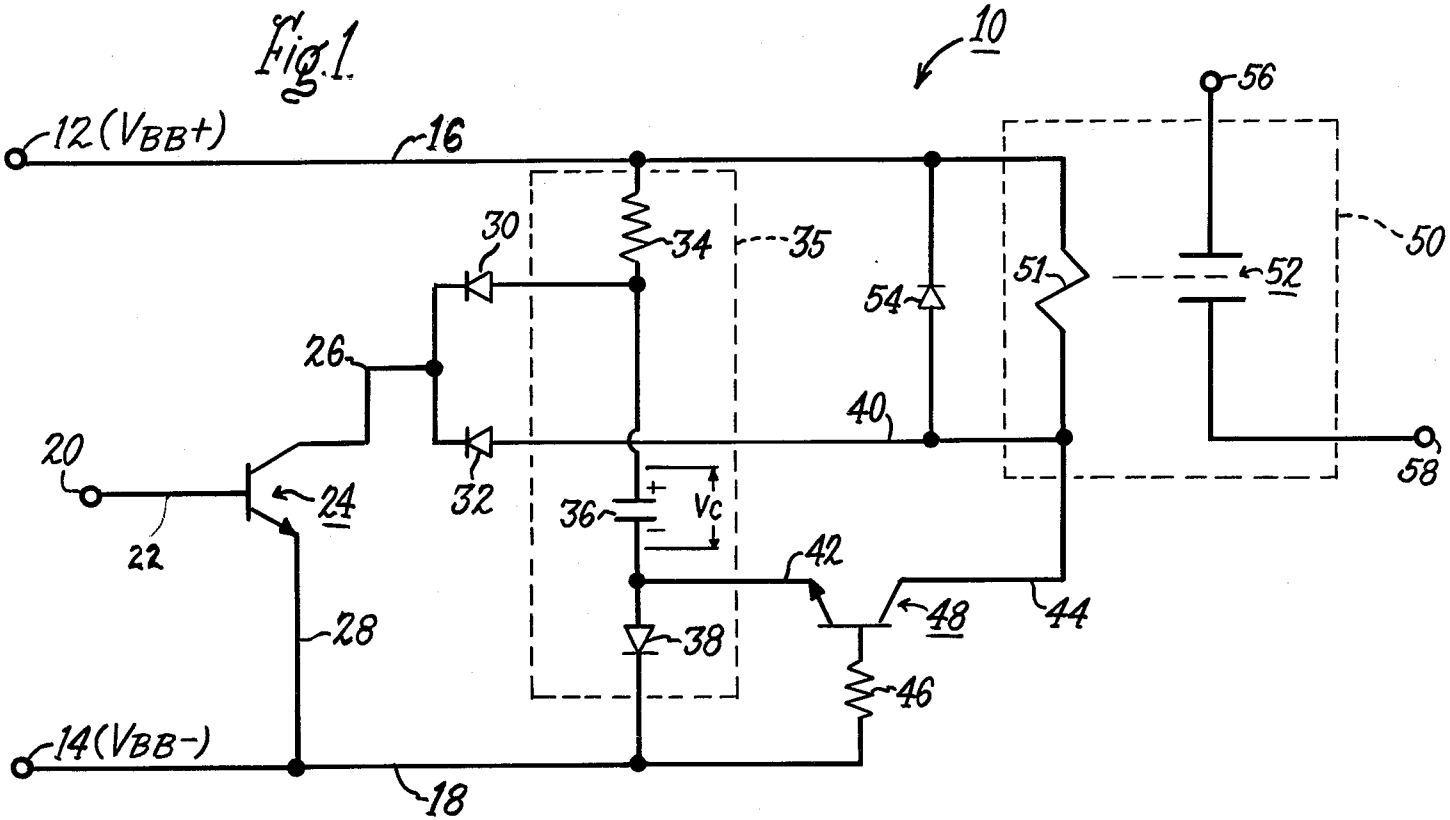
FIG. 1 is a circuit diagram of one embodiment of the present invention.

FIG. 1 shows a diagram of a relay drive circuit arrangement 10 in accordance with the preferred embodiment of the present invention. Circuit 10 has an input stage having a first transistor 24 and an output stage having a second transistor 48 which is used to control the actuation of an electromagnetic relay 50. Transistors 24 and 48 are shown as being of a NPN type transistor. However, it should be recognized that other types of transistors, such as Field Effect Transistors (FET) may also be used if desired. Transistors 24 and 48 respectively function as a first and second switching means having a first, a second, and a third electrode, which for a typical transistor are the emitter, the base, and the collector electrodes respectively. Similarly, electromagnetic relay 50 is shown as having a single pair of normally-open contacts 52 which become closed upon the energization of relay 50 to interconnect terminals 56 and 58. However, it should also be recognized that electromagnetic relay 50 may have other normally-open or normally-closed contacts that may be utilized for additional control functions.

In general, relay drive circuit 10 operates upon an occurrence of an electrical signal 20 to actuate relay 50, which, in turn, closes its contacts 52 interconnecting terminal 56 to terminal 58. The electrical signal 20 is typically transmitted to drive circuit 10 as a command signal to notify an external source (not shown), via the interconnection of terminals 56 and 58, that an alarm condition has been detected.

The drive circuit 10 is connected to a power supply (not shown), having a positive voltage potential $V_{BB}+$ and a negative voltage potential $V_{BB}-$, via terminals 12 and 14 respectively. The voltage potentials $V_{BB}+$ and $V_{BB}-$ are conducted to the components of drive circuit 10 via busses 16 and 18, respectively, as shown in FIG. 1.

The base of transistor 24 of drive circuit 10 is coupled to the applied electrical signal 20 via a conductor 22. The emitter of transistor 24 is connected to the buss 18 via a conductor 28. The collector of transistor 24 is connected to the cathodes of a pair of diodes 30 and 32 via conductor 26. The anode of diode 30 is connected to one side of a first resistor 34. The anode of diode 32 is connected, via conductor 40, to a first side of a parallel arrangement comprising an energizing coil 51 of the relay 50 and a diode 54. The second side of parallel arranged coil 51 and diode 54 is connected to the buss 16.

The collector of the second transistor 48 is also connected to the first side of the parallel arranged coil 51 and diode 54 via conductor 44. Transistor 48 has its base connected to the buss 18 via a second resistor 46. The emitter of transistor 48 is connected to one side of a capacitor 36 and also to the anode of a first diode 38 which is further connected to buss 18.

Capacitor 36, diode 38 and first resistor 34 are connected to form a serially-arranged resistor-capacitor-diode network 35, which as shown in FIG. 1, is connected across busses 16 and 18. This serially-arranged network 35 provides for the capacitor 36 to be charged to a potential substantially equal to the voltage difference between $V_{BB}+$ and $V_{BB}-$. The charged capacitor 36 provides for two (2) functions; (1) it controls the conductive state of transistor 48, and (2) it discharges the charge stored across capacitor 36 for the actuation of relay coil 51 upon the occurrence of the applied electrical signal 20. The result of charging network 35 is that the energizing coil 51 is energized with two levels of voltages, (1) a first relatively high voltage level for actuating or picking-up relay 50 to place it in its operate state and (2) a second voltage level which is lower than the first for maintaining or holding-in the operate state of relay 50.

Figure 2:
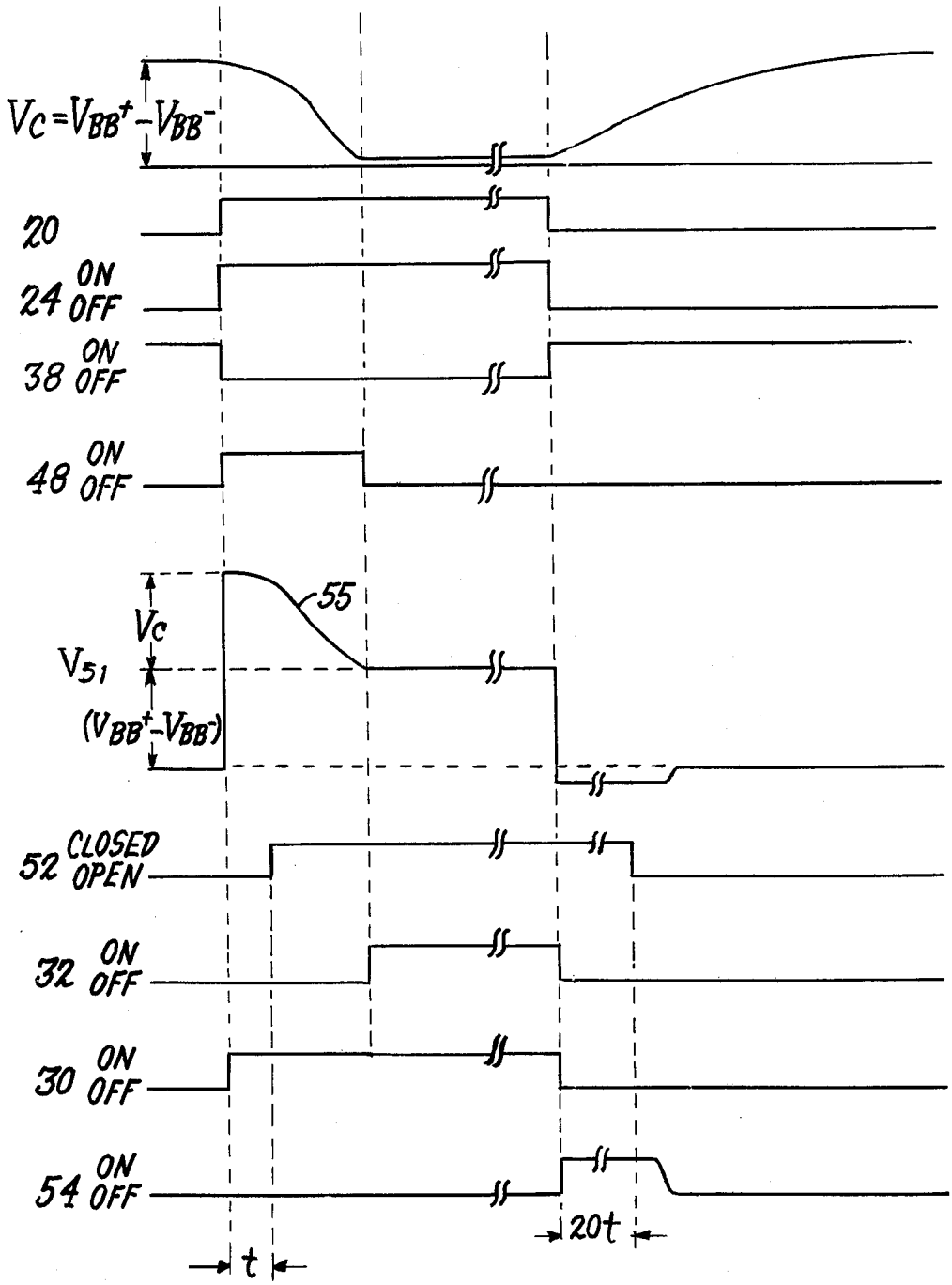
FIG. 2 is a timing diagram depicting the circuit operation of FIG. 1.

Reference is now made to the timing diagram of FIG. 2 which shows the sequence of the operation of the drive circuit 10. The operation of circuit 10 is controlled by the presence and absence of the applied signal 20. In the absence of signal 20 the initial condition of the capacitor 36 is that it is charged to a voltage $V_c$ having a value substantially equal to the voltage potential between ($V_{BB}+$ and $V_{BB}-$). Also in the absence of signal 20, further initial conditions of circuit 10 are, (1) transistor 24 is nonconductive or OFF, (2) transistor 48 is non-conductive or OFF, (3) diodes 30, 32, and 54 are non-conductive or OFF, (4) the voltage across relay coil 51, that is $V_{51}$, is zero and (5) relay 50 is its non-operate state and its contacts 52 are opened.

Upon the presence or occurrence of signal 20 the following events are initiated, (1) signal 20 renders transistor 24 conductive, (2) the conduction of transistor 24 provides a path to render diode 30 conductive, (3) the conduction of diode 30 provides a path to initiate a discharge of capacitor 36 which is charged to the voltage Vc, (4) the initiation of the discharge of the voltage Vc renders diode 38 non-conductive and conversely transistor 48 conductive, and (5) conduction of transistor 48 provides a path to couple the energizing coil 51 across a voltage potential which is the summation of the potential difference between ($V_{BB}+$ and $V_{BB}-$) and Vc. The internally developed voltage Vc is effectively a temporary serial battery source that becomes additive with the external power source ($V_{BB}+$ and $V_{BB}-$) upon conduction of transistors 24 and 48. The temporary and external sources become coupled across the energizing coil 51 with one end of coil 51 becoming coupled to the negative potential of capacitor 36 and the other end of the coil being connected to the $V_{BB}+$ potential. The total voltage potential applied across energizing coil 51 is substantially the combined voltage potential of the temporary and external power sources which is the summation of Vc and $V_{BB}+$ to $V_{BB}-$. Reference is now made back to FIG. 1 to further describe the interconnecting paths caused by the occurrence of signal 20.

The cathode of diode 30 becomes coupled to the $V_{BB}-$ potential (buss 18) upon the conduction of transistor 24 which in turn causes a forward-bias of diode 30 andcouple the positive terminal of capacitor 36 to buss 18 and initiates the discharge of Vc. The coupling of Vc to buss 18 provides a potential to (1) the cathode of diode 38 to render it non-conductive and (2) to the base of transistor 48 to render it conductive. Conduction of transistor 48 provides a path for the summation of the potential difference between $V_{BB}+$ and $V_{BB}-$ and Vc to be connected across relay coil 51. The result of the conduction of transistor 48 is that the voltage applied across coil 51 ($V_{51}$) is substantially equal to the sum of Vc and the potential difference between $V_{BB}+$ and $V_{BB}-$. The initial voltage $V_{51}$ is therefore substantially equal to twice the potential difference $V_{BB}+$ and $V_{BB}-$. The voltage $V_{51}$ is dependent upon the voltage Vc which decays in accordance with the circuit parameters of the inductive and resistive elements of coil 51 and the capacitance of capacitor 36. b 2) holding current for relay coil 51 flows from $V_{BB}+$, through coil 51, through diode 32, and transistor 24 to $V_{BB}-$. Diode 30 remains conductive because of the current of resistor 34, whereas transistor 48 becomes non-conductive because the voltage potential supplied by Vc which initially rendered transistor 48 conductive decreased to a value which will not sustain conduction. Reference is now made back to FIG. 2 to complete the description of the sequence of operation of the drive circuit 10.

The pick-up time of relay 50 is shown as a time t which is initiated upon the occurrence of electrical signal 20 and terminated before the mid-point, shown as 55, of the voltage decay of Vc. The termination of the pick-up time t is shown in FIG. 2 as occurring at a value equal to about one-half of the mid-point 55. It should be noted that the pick-up t for relay 50 is dependent on the amplitude of the voltage $V_{51}$. The higher the amplitude of $V_{51}$ the less the pick-up time of relay 50. For example, the pick-up time of relay 50 may be reduced to two thirds (2/3) of its initial value if the amplitude of $V_{51}$ is increased by a factor of two (2).

Upon the decay of Vc to its minimum value, the voltage $V_{51}$ has a value substantially equal to the voltage potential difference between $V_{BB}+$ and $V_{BB}-$. The voltage potential between $V_{BB}+$ and $V_{BB}-$ is typically chosen to be equal to or be greater than the voltage required to pick-up relay 50. Relay 50 continues to be energized for the remainder of the time period during the presence of input signal 20. Upon the termination of input signal 20 five (5) events occur; (1) transistor 24 becomes nonconductive, (2) diode 38 becomes conductive, (3) diode 30 becomes nonconductive, (4) diode 32 becomes nonconductive, and (5) the potential across relay coil 51 suddenly reverses because its inductive current not must flow through diode 54. The conduction of diode 38 completes a path of couple the charging network 35 across the busses 16 and 18 and produces a voltage potential rise across capacitor 36 (Vc) shown in FIG. 2. The charging rate of capacitor 36 is dependent upon the time-constant of network 35 which is determined by the values selected for resistor 34 and capacitor 36.

The voltage $V_{51}$ decreases to a value below its initial value upon the removal of signal 20 because of the electromagnetic relay 50 having an inductive type current flowing through its coil 51, begins to discharge its stored energy. The inductive current flowing through diode 54 provides a path to discharge the stored energy in the coil 51. Conduction of diode 54 allows the coil 51 to deenergize and thus allow the relay contacts 52 to open. The time required for the inductive current to decay and the contacts to operate is commonly known as the drop-out time, and is shown in FIG. 2 as 20 t. The usage of the term "20 t" is meant to represent that the discharge time of relay 50 is approximately 20 times its pick-up time t. The drive circuit 10 remains in this condition until the reoccurrence of the electrical signal 20.

It should now be appreciated that drive circuit 10 provides an actuating electrical signal $V_{51}$ for the electromagnetic relay 50 having two amplitude levels, (1) an initial or first amplitude having a value substantially equal to twice the voltage potential between $V_{BB}+$ and $V_{BB}-$, for actuating relay 50 and (2) a reduced or second amplitude which is substantially equal to the voltage potential between $V_{BB}+$ and $V_{BB}-$ for maintaining actuation or holding-in of relay 50. The first amplitude of $V_{51}$ may be chosen to greatly enhance the pick-up time of relay 50 whereas the second amplitude of $V_{51}$ need only be sufficient to maintain actuation of relay 50.

Figure 3:
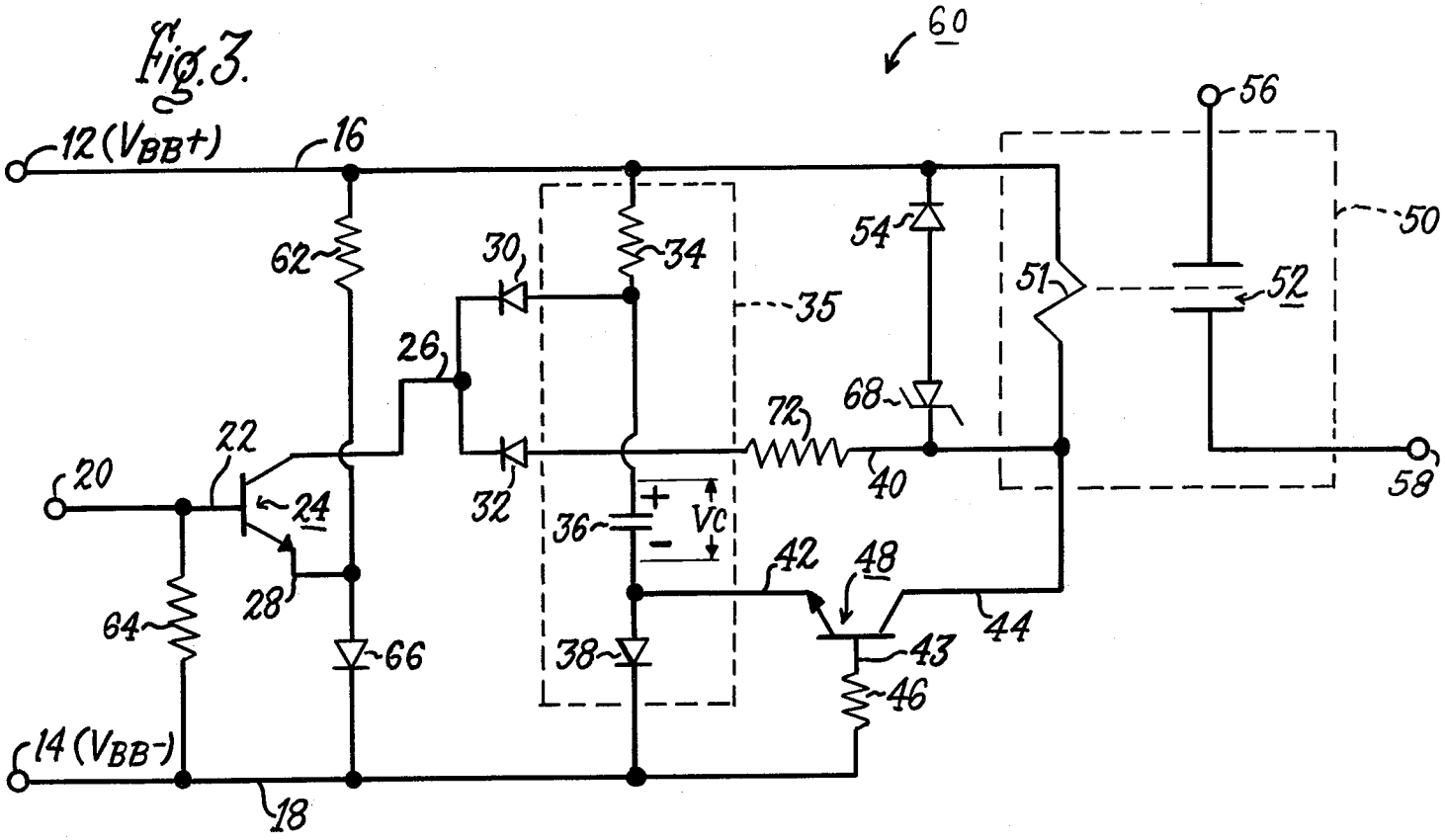
FIG. 3 is a circuit diagram of another embodiment of the present invention.

The drive circuit 10, shown in FIG. 1, may be improved by a drive circuit 60 shown in FIG. 3 depicting an alternate embodiment of the present invention. Drive circuit 60 is similar to drive circuit 10 except for the following additions; drive circuit 60 has resistors 62 and 64 and a diode 66 added as a bias arrangement for the emitter of transistor 24, a zener diode 68 serially connected to diode 54, and a resistor 72 interconnected between diode 32 and energizing coil 51.

Resistor 62 and diode 66 provide a predetermined voltage at the emitter of the transistor 24. Resistor 64 is selected such that the current that may be present during the absence of signal 20 may develop a voltage potential across resistor 64 that has a value slightly less than the voltage potential across the forward conducting diode 66 to thereby maintain transistor 24 nonconductive during the absence of signal 20.

The zener diode 68 increases the voltage drop provided by a discharge path formed by diode 54 and zener diode 68, which in turn decreases the time required to decrease the stored inductive energy inherent in the energized relay 50 and thus shortens the drop-out time of relay 50. Resistor 72 is serially added to diode 32 to reduce the holding current for energizing coil 51. Resistor 72 may be selected to adapt the holding current of drive circuit 60 to that which may be desired for relay 50.

It should now be appreciated that both drive circuits 10 and 60 each having an internal charging network provide a means in which the speed of response of the electromagnetic relay is greatly enhanced without requiring any increase to the voltage requirement of the power source of a subsystem.

While I have shown and described particular embodiments of my invention, it will be obvious to those skilled in the art that various changes and modifications may be made without departing from my invention in its broader aspects; and I, therefore, intend herein to cover all such changes and modifications as fall within the true spirit and scope of my invention.

What is claimed is:

1. A drive circuit responsive to an applied electrical signal for controlling the actuation of a relay having an energizing coil with a first and a second end arranged across an output stage of the circuit, said circuit being adapted to be energized by a D.C. voltage present between a positive and a negative potential, said circuit comprising;

a charging circuit comprising a serially-arranged first resistor, a capacitor, and a first diode, said first resistor having a first end connected to said positive potential, said first diode having its cathode connected to said negative potential, a second and a third diode, said second and third diodes each having their cathodes connected together at a first end, said second diode having its anode connected to a second end of said first resistor and to a first end of said capacitor, said third diode ectrode being connected to said negative potential, said second electrode being adapted to receive said electrical applied signal, and said third electrode being coupled to the connected cathodes of said second and third diodes, said first switching means being arranged so that (i) when in its nonconductive state it allows said capacitor to be charged to a voltage substantially equal to said D.C. voltage and (ii) upon the occurrence of said applied electrical signal it is rendered conductive and supplies a path to forward-bias said second diode and initiate a discharge of said capacitor;

a second switching means having first, second and third electrodes, said first electrode being connected to a second end of said capacitor, said second electrode being coupled by a second resistor to said negative said energizing coil for dissipating inductive stored energy;

said charging circuit, said second and third diodes, and said first and second switching means being arranged so that upon the occurrence of said applied electrical signal, both of said first and second switching means are rendered conductive and an initial voltage equal to the sum of the charged potential of said capacitor and said D.C. voltage is applied across said energizing coil to actuate said relay.

2. A circuit according to claim 1 wherein said initial voltage decreases upon discharge of the capacitor to a value substantially equal to said D.C. voltage which is sufficient to maintain actuation of said relay.

3. A circuit according to claim 1 wherein said means for dissipating inductive stored energy of said energizing coil comprises a fourth diode having its cathode connected to said first end of said energizing coil and its anode connected to said second end of said energizing coil, said fourth diode providing a conductive path for dissipating inductive stored energy which flows upon the termination of said applied electrical signal.

4. A relay drive circuit according to claim 3 further including a zener diode having an anode and a cathode, said zener diode being serially connected with said fourth diode, wherein said serially connected zener diode and said fourth diode reduces the drop-out time of said relay.

5. A relay drive circuit according to claim 1 further including a fourth diode, a third resistor and a fourth resistor;

said fourth diode and said third resistor being serially arranged across said D.C. voltage with the cathode and the anode of said fourth diode being connected respectively to said negative potential and to said emitter electrode of said first transistor, said fourth resistor connected between said base electrode of said first transistor and said negative potential, said fourth diode and said third and fourth resistors selected to provide a bias voltage between said emitter and said base electrodes that is less than required to render said first transistor conductive.

6. A relay drive circuit according to claim 1 further including a fifth resistor interconnected between said first end of said energizing coil and said anode of said third diode, said fifth resistor reducing a holding current flowing through said energizing coil, whereby selection of the resistance value of said fifth resistor correspondingly adapts the holding current to that desired for said relay.

7. A circuit according to claim 1 wherein said first switching means comprises a first transistor and wherein the first electrode is an emitter of the first transistor, the second electrode is the base of the first transistor and the third electrode is the collector of the first transistor, and wherein said second switching means comprises a second transistor and wherein the first electrode is an emitter of the second transistor, the second electrode is the base of the second transistor and the third electrode is the collector of the second transistor.

* * * * *